US005966577A

United States Patent [19]

Abe

[11] Patent Number: 5,966,577

[45] Date of Patent: Oct. 12, 1999

[54] HEATER AND HEAT FIXING APPARATUS HAVING A RESISTANCE ADJUSTMENT PORTION

[75] Inventor: Atsuyoshi Abe, Yokohama, Japan

[73] Assignee: Canon Kabushiki Kaisha, Tokyo, Japan

[21] Appl. No.: 08/491,373

[22] Filed: Jun. 19, 1995

[30] Foreign Application Priority Data

Jun. 20, 1994 [JP] Japan ..... 6-160673

[51] Int. Cl.[6] ..... G03G 15/20

[52] U.S. Cl. ..... 399/320; 219/216; 399/328

[58] Field of Search ..... 355/282, 285, 355/289, 290; 219/216; 399/320, 328, 329, 335

[56] References Cited

U.S. PATENT DOCUMENTS 5,148,124 9/1992 Goff ..... 331/78
5,338,919 8/1994 Tagashira et al. ..... 219/543
5,359,352 10/1994 Saita et al. ..... 347/62
5,466,484 11/1995 Spraggins et al. ..... 437/228

FOREIGN PATENT DOCUMENTS 0362791 4/1990 European Pat. Off. ..... 355/289
63-313182 12/1988 Japan .

*Primary Examiner*—William J. Royer
*Attorney, Agent, or Firm*—Fitzpatrick, Cella, Harper & Scinto

[57] ABSTRACT

A heater includes a substrate; a heat generating resistor on the substrate to generate heat when supplied with electric energy; a pair of electrodes for supplying the energy to the heat generating resistor; and a resistance adjustment portion for adjusting the resistance between the electrodes. The resistance adjustment portion adjusts the resistance while maintaining uniform electrical conductivity between the electrodes and the heat generating resistor.

28 Claims, 10 Drawing Sheets

HEATER AND HEAT FIXING APPARATUS HAVING A RESISTANCE ADJUSTMENT PORTION

FIELD OF THE INVENTION AND RELATED ART

The present invention relates to a heat fixing apparatus used in an image forming apparatus such as a copying machine, a printer, or the like, in particular, a heater used in the heat fixing apparatus.

Heretofore, a fixing apparatus of a heat roller type has been generally employed as an apparatus for fixing an image. This heat roller type fixing apparatus comprises a fixing roller containing a metallic roller, and an elastic pressure roller, wherein a toner image is fixed with heat and pressure, as a recording medium is passed through a fixing nip formed between this pair of rollers.

However, in the case of this heat roller type image fixing apparatus, the thermal capacity of the roller is rather large. Therefore, it takes a long time for the roller temperature to reach a predetermined fixing temperature (startup time, warmup time, or wait time is long). Thus, in order to reduce the waiting time, it is required that the heat roller temperature be kept at a certain level. This requirement also applies to the fixing apparatuses of other types: for example, heat plate type and oven fixing type.

Therefore, the applicant of the present invention has proposed a fixing apparatus of a film-assisted heating type comprising a heater and a film in contact with the heater, in a Japanese Laid-Open Patent Application No. 313,182/1988 and the like publications.

In a fixing apparatus of this film-assisted heating type, a heater with a small thermal capacity such as the one illustrated in FIG. 10 is used as heating means, making it possible to reduce the waiting time (apparatus gets ready quickly), in comparison with a fixing apparatus of the conventional heat roller type or the like, Further, since the apparatus gets ready quickly, it is unnecessary to keep it warm while not in use, which saves energy in terms of the overall energy consumption Also, it enjoys the advantage that it can solve various shortcomings of other systems. In other words, the fixing apparatus of the film-assisted heating type is very effective.

However, the fixing apparatus of the film-assisted heating type surfers from the following problems, which will be described with reference to FIG. 10.

Generally, a heating member 100 is produced through the following process.

(1) Patterns of a heat generating resistor layer 3 and terminal electrode layers 3*a* and 3*c* are printed to a thickness of approximately 10 $\mu$m on a piece of ceramic substrate 2 as heater substrate, using a screen printing method. As for printing ink, so-called "thick film paste" is used, which is the mixture of electrically conductive microscopic particle, organic binder such as glass frit or ethyl cellulose, and solvent.

(2) The substrate carrying the above described printed patterns is baked at a temperature of 600° C. or higher, whereby the heat generating resistor layer 3, and terminal electrode layers 3*a* and 3*c* are baked onto the substrate 2.

(3) After cooling, the heat generating resistor layer 3 on the substrate 2 is covered, using a printing method, with glass paste, which forms a glass layer 4, that is, a surface protective layer, as it is baked at a high temperature.

(4) A temperature sensor element 5, a safety fuse 6 and the like are assembled onto this substrate 2 processed as described above, completing thereby the heating member 100. A reference numeral 8 designates a power supply circuit which controls the power supplied to the heat generating resistor member In reality, however, the heat generating members thus finished substantially vary in the resistance value of the heat generating resistor layer 3, due to the difference in the thickness of the layer 3, ink lot, baking conditions, or the like.

When the resistance value is small, and therefore, a large amount of heat is generated, the heating member temperature is liable to overshoot, or ripple excessively, whereas when the resistance value is large, and therefore, a small amount of heat is generated, it takes a longer time for the heating member to reach a predetermined target temperature. In the case of the film-assisted heating type system, the film is interposed between the recording medium and the heater pressed thereupon; therefore, the above described shortcomings of the film-assisted heating type system manifest as fixing defects.

Occurrence of such nonuniformity of the physical properties among the individual heating members can be prevented by screening the heating members, more specifically, by reducing the nonuniformity in the resistance value among the heating members. However, such screening reduces the heating member yield, increasing thereby the manufacturing cost.

SUMMARY OF THE INVENTION

The primary object of the present invention is to provide a heater, the heat generating capacity of which can be adjusted so that its yield can be improved, and a heat fixing apparatus employing such a heater.

According to an aspect of the present invention, a heater, and a heat fixing apparatus comprising a heater, comprise a resistance adjustment portion which is disposed between a heat generating resistor and electrodes in order to adjust the resistance between the electrodes.

According to another aspect of the present invention, a heater, and a heat fixing apparatus comprising a heater, comprise a high resistance portion, which is disposed between a heat generating resistor and electrodes; the width of which is wider than that of the heat generating resistor; and the resistance value of which is higher than those of the electrodes.

These and other objects, features and advantages of the present invention will become more apparent upon a consideration of the following description of the preferred embodiments of the present invention, taken in conjunction with the accompanying drawings.

DESCRIPTION OF THE PREFERRED EMBODIMENTS

Hereinafter, the embodiments of the present invention will be described with reference to the drawings.

Figure 1:
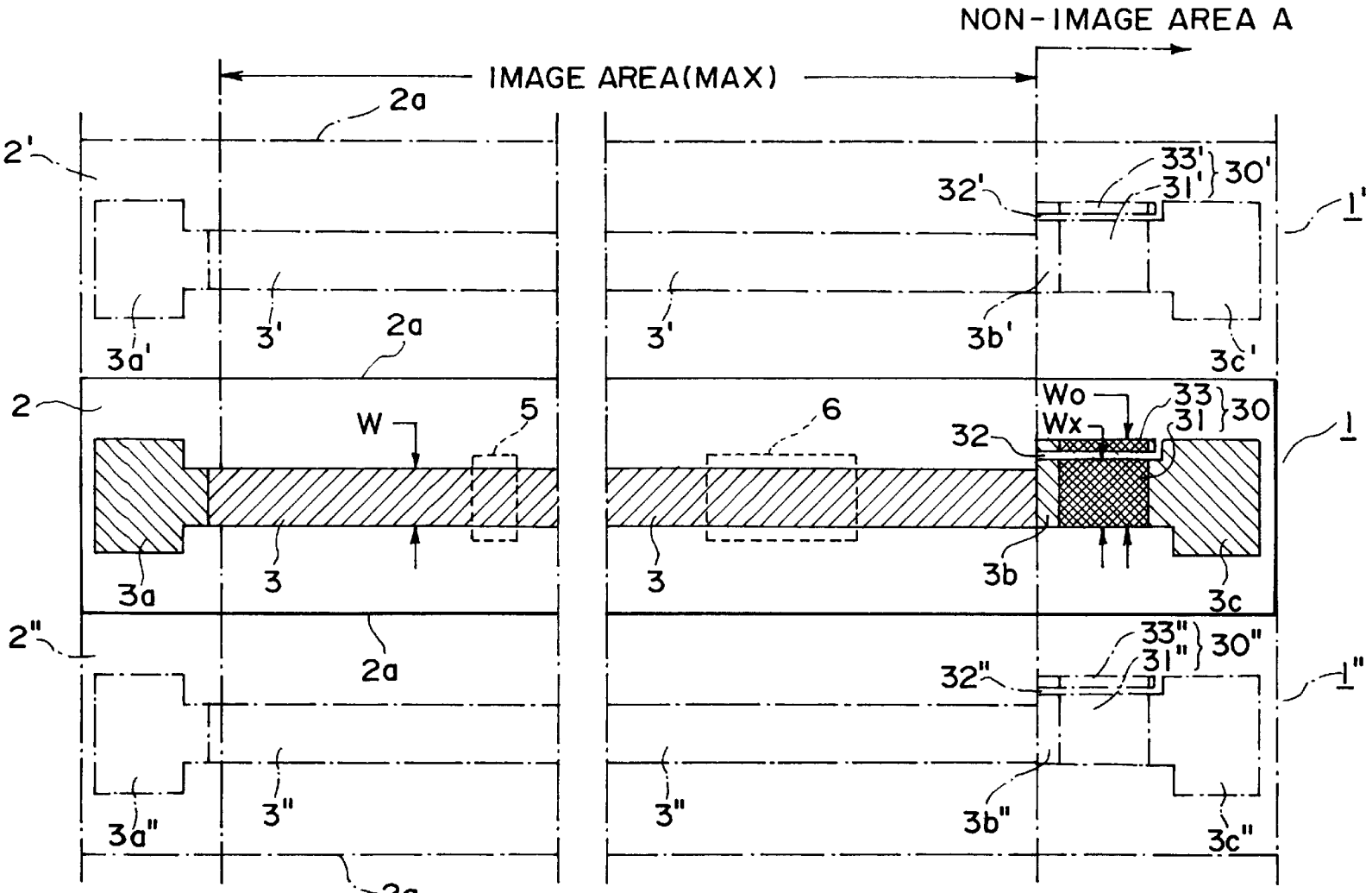
FIG. 1 is a plan view of an embodiment of a heater in accordance with the present invention.
Figure 8:
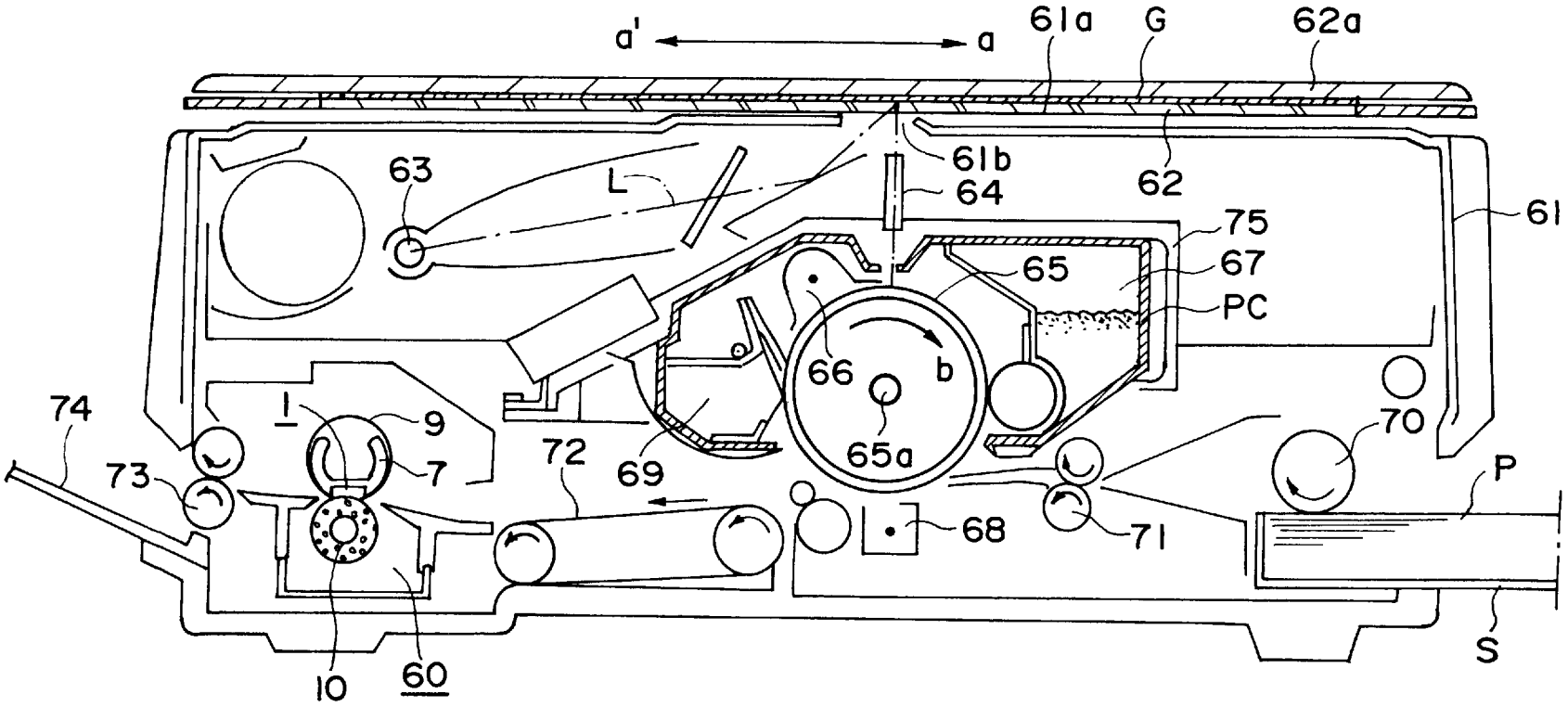
FIG. 8 is a schematic side view of an image forming apparatus to which the present invention is applicable.
Figure 9:
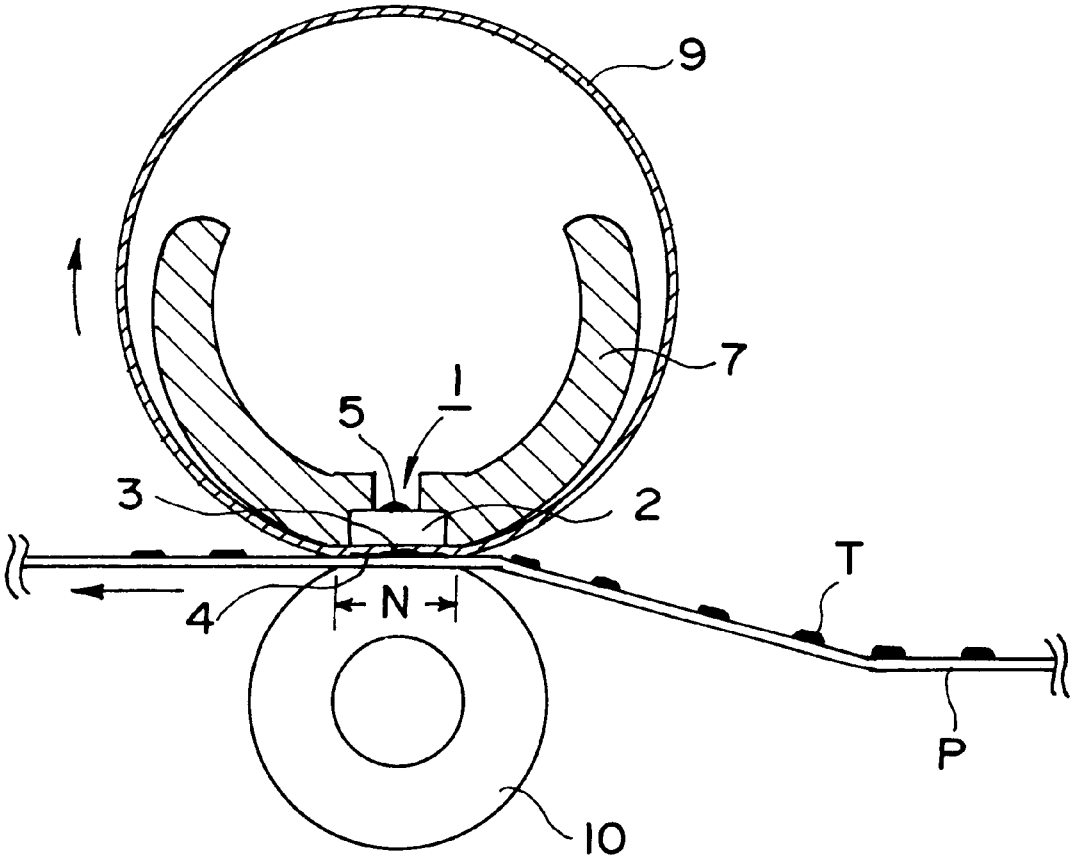
FIG. 9 is a schematic sectional side view of a heat fixing apparatus to which the present invention is applicable.
Figure 10:
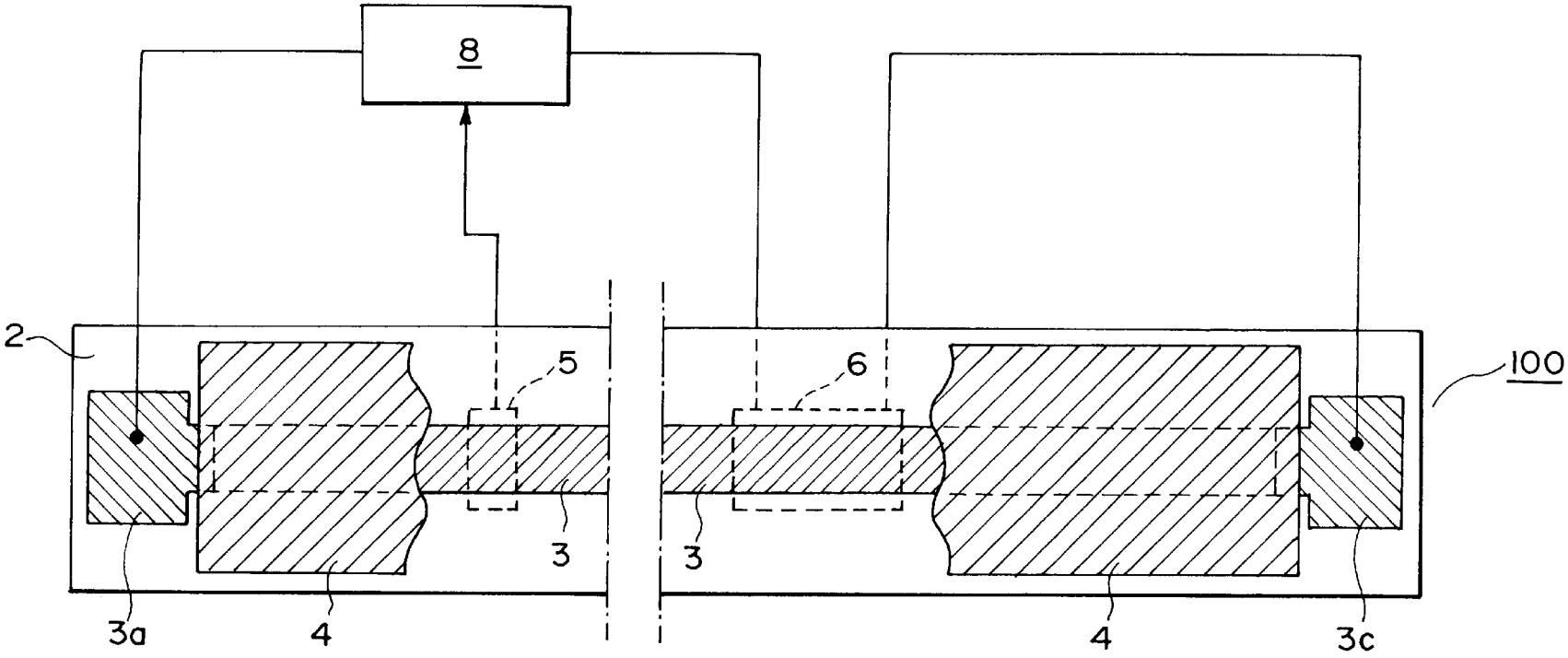
FIG. 10 is a plan view of a conventional heater which provided the background technology for the present invention.

FIG. 1 is a plan view of an embodiment of a heater in accordance with the present invention. FIG. 9 is a schematic sectional view of a heat fixing apparatus comprising the heater illustrated in FIG. 1. FIG. 8 is a schematic sectional view of an image forming apparatus comprising the heat fixing apparatus illustrated in FIG. 9.

To begin with, the image forming apparatus will be described with reference to FIG. 8.

The image forming apparatus in this embodiment is an electro-photographic copying apparatus of a transfer type. It comprises a reciprocal original table, a rotary drum, and a replaceable process cartridge.

A reference numeral 61 designates an apparatus housing, and 62 designates a reciprocal original table formed of transparent material such as glass or the like. The reciprocal original plate 62 is disposed on the top plate 61*a* of the apparatus housing 61*a*, and is reciprocally driven side to side (right a and left a') on the top plate 61*a* of the housing at a predetermined speed.

An alphabetic referential symbol G designates an original. The original G is placed on the top surface of the original table 62, with the surface of the original G having the image to be copied facing downward, and is pressed down with an original pressing plate 62 which is placed thereon in such a manner as to cover the original.

An alphanumeric reference 61*b* designates a slit as an opening through which the original is illuminated. It is cut in the top plate 61*a* of the housing, in the direction perpendicular to the reciprocating direction of the original table 62 (direction perpendicular to the surface of the drawing).

The downward facing, image bearing surface of the original placed on the original table 62 is moved from right to left across the alit 61*b* as the original table 62 is moved to the right a. While the original on the transparent original table 62 is moved across the slit 61*b*, it is scanned through the slit 61*b* a light L emitted from a lamp 63. The scanning light reflected by the original surface is focused on the surface of a photosensitive drum 65 by an imaging element array 64, whereby a latent image reflecting the original image is formed on the exposed surface of the photosensitive drum 65.

The photosensitive drum 65 is coated with a layer of photosensitive material such as zinc oxide, organic semiconductor, or the like, and is rotatively driven about its central rotational axis 65*a* in the direction of an arrow mark b at a predetermined speed. While being rotated, it is uniformly charged to the positive or negative polarity by a charger 66. As this uniformly charged surface of the photosensitive drum 66 is exposed to the aforementioned scanning light reflected by the original surface through the slit (slit exposure), an electrostatic latent image correspondent to the scanned original surface is formed on the surface of the photosensitive drum 65 in a manner of scanning.

The electrostatic latent image thus formed is visualized by toner composed of resin or the like, which softens or melts when heated by a developing device 67. The visualized toner image is carried toward a location where a transfer charger 68 as a transfer station is disposed.

An alphabetic reference S designates a cassette in which transfer sheets P as recording medium have been loaded. The sheets within this cassette are fed out one by one and are delivered to a register roller 71 as a feeder roller 70 rotates. Then, the sheet P having arrived at the register roller 71 is fed further with such a timing that when the leading end of the toner image formation area on the photosensitive drum 65 reaches the location of a transfer charger 68, the leading end of the transfer sheet P synchronously arrives at the location between the transfer charger 68 and photosensitive drum 65.

Then, the toner image an the photosensitive drum 65 is sequentially transferred by the transfer charger 68, onto the recording sheet thus delivered.

The recording sheet, onto which the toner image has been transferred in the transfer station, is separated from the surface of the photosensitive drum 65 by an unillustrated separating means, and is guided by a conveying apparatus 72 to the aforementioned fixing apparatus 60, in which the unfixed toner image T carried on the recording sheet is thermally fixed. Thereafter, the recording sheet is discharged as a copy into a discharge tray 74 through a discharge roller pair 73.

After the image transfer, the surface of the photosensitive drum 65 is cleaned of adhering contaminants such as residual toner by a cleaning apparatus 69, to be repeatedly used for image formation.

A reference symbol PC designates a process cartridge which is installed into, or removed from, a cartridge accommodating space 75 provided within the apparatus housing 61. The process cartridge in this embodiment integrally comprises four processing devices: a photosensitive drum 65 as an image bearing member, a charger 66, a developing device 67, and a cleaning apparatus 69.

Next, referring to FIG. 9, the heat fixing apparatus will be described.

The heat fixing apparatus in this embodiment comprises a heating member, a film guide member which holds the heating member, a cylindrical heat resistant film fitted loosely around the circumference of the film guide member, and a pressure roller which presses the film onto the heating member. As the pressure roller is rotatively driven, the film is rotated in such a manner that the inward facing surface thereof slides on the surface of the heating member, being tightly pressed thereupon. In other words, the heat fixing apparatus in this embodiment is a film-assisted fixing apparatus of a so-called tensionless type, in which the film is driven by the pressure roller.

A reference numeral 1 designates a heating member comprising a heater substrate 2 (ceramic substrate), which is heat resistant, electrically nonconductive, and low in thermal capacity, and a heat generating resistor layer extending on the substrate 2 in the longitudinal direction thereof, and a glass layer 4 as the surface protective layer which coats the heat generating resistor layer and substrate 2.

The exposed surface of the glass layer 4 of the heating member 1 is the surface on which the film slides. The heating member 1 is supported by the downward facing surface of the thermally insulating film guide member (heating member holder) 7, in such a manner as to expose the surface of the glass layer 4, wherein the film guide member 7 is fixedly supported by an unillustrated static member of the apparatus main assembly.

A reference numeral 9 designates an approximately 40 $\mu$m thick heat resistant cylindrical film of polyimide or the like material. This cylindrical film 9 is loosely fitted around the peripheral surface of the film guide member 7, which supports the heating member 1.

A reference numeral 10 designates a rotary pressure roller as a pressing member which presses the film 9 onto the surface of the glass layer 4 of the heating member 1, that is, the surface on which the film slides. As the pressure roller 10 is rotatively driven, the film 9 is rotatively moved in the direction of an arrow mark at a predetermined speed, while being pressed on the heating member 1 by the pressure roller 9, and sliding on the surface of the heating member 1.

The temperature of the heating member 1 is raised to a predetermined temperature by supplying the power to the heat generating resistor layer 3. Then, while the film 9 is slid on the heating member 1, the recording material P, the member to be heated, is introduced into a compression nip (fixing nip) N, formed between the film 9 and pressure roller 10, whereby the recording material P is passed through the compression nip N (location of the heating member), along with the film 9, being firmly placed in contact with the surface of the film 9. While the recording material P is passed through the nip N, thermal energy is transferred from the heating member 1 to the recording material P through the film 9, whereby the unfixed toner image T, carried on the recording material P, is heated, melted, and subsequently, fused (fixed) to the recording material P.

Next, referring to FIG. 1, the heater will be described. In FIG. 1, a reference numeral 2 designates a piece of substrate; 3, a heat generating resistor layer; and 3*a*, 3*b* and 3*c* designate electrode layers (electrically conductive layers).

As a voltage is applied by the power supply circuit between the terminal electrode layers (electrically conductive layers) 3*a* and 3*c*, disposed at the correspondent longitudinal ends of the heat generating resistor layer 3, the heat generating resistor layer 3 generates heat, which raises the temperature of the heating member 1. The voltage is not applied directly to the electrode 3*b*, which simply serves as an electrically conductive member with preferable conductivity.

A reference numeral 5 designates a temperature sensor element such as thermistor or the like, which is disposed in contact with the back surface of the heater substrate 2 of the heating member 1. The temperature information detected by the temperature sensor element 5 is inputted to the heating member temperature control system of the power supply circuit in order to control the power supply to the heat generating resistor layer 3, whereby the heating member temperature is maintained at a predetermined temperature.

A reference numeral 6 designates a safety fuse (thermal fuse) as a thermal protector, which is disposed in contact with the back surface of the heater substrate 2 of the heating member 1, and is placed in series within the power supply passage leading to the heat generating resistor layer 3. When the temperature of the heating member 1 increases beyond a predetermined one, it melts to interrupt the power supply to the heat generating resistor layer 3.

In this embodiment, the heating member 1 was produced using the following method. FIG. 1 is a schematic plan view of the heating member 1.

(1) The patterns of electrode layers 3*a*, 3*b* and 3*c* (3*a*,' 3*b*' and 3*c*'; 3*a*," 3*b*" and 3*c*," . . . ) are printed and baked on a piece of alumina substrate 2, the heater substrate, which has a size large enough to afford a plurality of heating members, using a low resistance silver-palladium paste.

(2) The narrow belt-like patterns of the heat generating resistor layer 3 (3,' 3," . . . ), which have a predetermined width W, are printed and baked on the substrate 2 between the electrode layers 3*a* and 3*b*, in contact with the electrode layers 3*a* and 3*b*, using a high resistance silver-palladium paste.

(3) The narrow belt-like patterns of adjustable resistor layer 30 (30,' 30," . . . ), having a pre-adjustment width $W_0$, are printed and baked on the substrate 2 between the electrode layers 3*b* and 3*c* (3*b*' and 3*c*,' 3*b*" and 3*c*," . . . ), using a high resistance silver-palladium paste. These adjustable resistor layers 30 (30,' 30," . . . ) constitute resistance adjustment regions 30, wherein a terminology, "pre-adjustment," means "right after printing."

The pre-adjustment width $W_0$ of the resistance adjustment region 30 in the direction perpendicular to the direction of the power supply (direction perpendicular to the longitudinal direction of the heater) is wider than the width W of the heat generating resistor layer 3 in the same direction.

The adjustable resistor layer 30, the resistance adjustment layer, is formed in an off-image region A, that is, outside the passingi area of the maximum recording medium.

(4) The pre-adjustment resistance value $R_{ac}$ between the electrode layers 3*a* and 3*c* (3*a*' and 3*c*,' 3*a*" and 3*c*," . . . ) is measured.

The pre-adjustment resistance values $R_{ab}$ and $R_{bc}$ between the electrode layers 3*a* and 3*b*, and between the electrode layers 3*b* and 3*c*, respectively, are measured.

The pre-adjustment resistance value $R_{ac}$ can be calculated by:

$$i\ R_{ac}=R_{ab}+R_{bc}$$

(5) The resistance value of the adjustable resistor layer 30 is set on the lower side, which is accomplished by giving the layer 30 the pre-adjustment width $W_0$, which is wider than the target width $R_x$ for the layer 30.

The resistance value of the heating member can be adjusted to a resistance value $R_T$ by means of changing the width $W_0$ of the resistor layer 30, the resistance adjustment region, to the width $W_x$. There is the following relation between the target resistance value $R_T$ and the post-adjustment (adjusted) width $W_x$:

$$R_T=R_{ab}+(W_0/W_x)\cdot R_{bc}$$

The adjusted width $W_x$ of the resistance adjustment region can be derived from the following formula:

$$W_x=W_0\cdot R_{bc}/(R_T-R_{ab})$$

(6) The portion of the resistor layer 30, the resistance adjustment region, equivalent to the excess width of the adjustable resistor layer 30 in the direction perpendicular to the longitudinal direction of the heat generating resistor layer is separated from the resistor layer 30, so that the width of the resistor layer 30 is adjusted (reduced) to the width $W_x$ calculated using the above formula. This is accomplished by means of cutting an approximately 100 $\mu$m wide slit 32 (32,' 32," . . . ) in the resistor layer 30 using a CO2 layer.

A reference numeral 31 (31,' 31," . . . ) designates the portion of the adjustable resistor layer 30, the width of which has been adjusted to the width $W_x$, and a reference numeral 33 (33,' 33," . . . ) designates the portion equivalent to the shaved excessive width. The portions equivalent to the slit 32 are the eliminated portions of the resistance adjustment region and electrically conductive layer.

In this embodiment, the width $W_x$ of the adjusted resistance adjustment region 31 in the direction perpendicular to the power supply direction is still wider than the width W of the heat generating resistor layer 3 in the same direction. When the width of the resistance adjustment region 31 is narrower than that of the heat generating resistor layer 3, the temperature of the resistance adjustment region increases, which is not preferable.

The adjusted resistor layer portion 31, the width-adjusted portion of the resistance adjustment region, is connected to the electrode layers 3*b* and 3*c* at the correspondent end.

The separated resistor layer portion 33, the portion equivalent to the excess width, is disconnected, physically and electrically, from the electrode layers 3*b* and 3*c* at the correspondent end, by the slit 32.

Therefore, when a voltage is applied between the electrode layers 3*a* and 3*c*, the power is supplied to the adjusted resistor layer portion 31, but not to the cutaway excess portion 33.

(7) The processes described in (4), (5) and (6) are carried out on all of the plurality of resistor layers 30, 30,' 30," . . . , the adjustable resistor layers, which are formed on the alumina substrate.

(8) A layer of glass paste is coated on the alumina substrate 2 using a printing technology, and is baked to form the glass layer 4 as the surface protective layer.

(9) After splitting lines 2*a* are made by the CO2 laser among the plurality of heating members 1, 1,' 1," . . . , which are formed on the same alumina substrate 2, the alumina substrate 2 is split along the splitting lines, yielding thereby the plurality of the independent heating members 1, 1, ' 1," . . . ,

(10) The temperature detecting element 5, safety fuse 6 and the like are assembled onto each heating member 1, completing thereby the heating member 1.

According to the above described embodiment, a portion of the adjustable resistor layer 30, the resistance adjustment region, of each heating member 1 is isolated to adjust the width of the adjustable resistor layer 30, from the pre-adjustment width $W_0$ to the width $W_x$, correspondent to the target resistance value $R_T$, which does not require shaving of the heat generating resistor layer 3 or the like process; therefore, even when there is nonuniformity in the resistance among the heat generating resistor layers 3 due to the difference in the thickness of the layer, the lot of the paste, the baking condition, or the like, the nonuniformity in the resistance value between the electrodes 3*a* and 3*c* can be reduced to an extremely small level among the heating members 1 in the finished form, without affecting the heat distribution of the heat generating resistor layer 3.

As a result, the rejection ratio for the finished heating member drops to an extremely small one, reducing thereby the manufacturing cost.

Further, in this embodiment, the adjusted width of the resistance adjustment region in the direction perpendicular to the power supply direction is wider than the width of the heat generating resistor layer; therefore, it is possible to repeat the adjustment.

FIG. 1 illustrates a case in which the portion 33 of the resistor layer 30, the resistance adjustment region, equivalent to the excess width, is electrically disconnected from the electrode layers 3*b* and 3*c* at each end, respectively, by being separated therefrom by the slit 32. However, a different configuration may be adopted: for example, one end of the excess portion 33 is separated from the correspondent side of the electrode by the slit, and the other end is left connected to the correspondent side of the electrode layer.

In such a case, it is conceivable that when a high voltage spike noise is present between the terminal electrode layers 3*b* and 3*c*, sparks may fly across the slit, which may cause a fire; therefore, it is preferable that a filter or the like is disposed within the electrical circuit.

However, when both ends of the excess width portion 33 are separated from the correspondent electrode layers 3*b* and 3*c* by the slit 32, being thereby electrically disconnected, as illustrated in FIG. 1, the interposition of such a filter or the like is unnecessary.

Further, in this embodiment, the resistance value of the resistance adjustment region was adjusted by adjusting the width of the resistor layer. However, as long as the resistance adjustment is done within the resistance adjustment region, there is no limitation with regard to the configuration of the portion to be separated, and the method for separating it.

Next, referring to FIG. 2, another embodiment of the present invention will be described.

This embodiment is similar to the preceding embodiment except that the portion 33 equivalent to the excess width of the adjustable resistor layer 30 as the resistance adjustment region was entirely erased. A reference numeral 34 designates the area from which the portion 33 has been entirely eliminated.

As a means for removing entirely the excess width portion 33, the entire area correspondent to the excess width portion 33 may be scanned by the same CO2 laser which was used to cut the 100 $\mu$m wide slit 33.

When the excess width portion 33 is entirely erased, the occurrence of sparking can be prevented even when a spike noise with a much higher voltage is present between the terminal electrode layers 3*b* and 3*c*.

Next, referring to FIG. 3, another embodiment of the present invention will be described.

In this embodiment, the heating member 1 was produced in the following manner.

(1) The patterns of electrode layers 3*a* and 3*c* are printed and baked on a piece of alumina substrate 2, the heater substrate, which has a size large enough to afford a plurality of heating members, using a low resistance silver-palladium paste.

(2) The narrow belt-like patterns of the heat generating resistor layer 3, which have a predetermined width W length of L, and an adjustable resistor layer 30 (the resistance adjustment region) which has a predetermined width of $W_0$ and a predetermined length of $L_0$, are printed and baked on the substrate 2 between the electrode layers 3*a* and 3*c*, in contact with the correspondent electrode layers 3*a* and 3*c*, using a high resistance silver-palladium paste. In other words, the heat generating resistor layer 3 and resistance adjustment region 30 are contiguously formed using the same material.

It should be noted here that the adjustable resistor layer 30, the resistance adjustment region, is formed outside the path of the image forming region of the recording material to be heated.

(3) The pre-adjustment resistance value $R_{ac}$ between the electrode layers 3*a* and 3*c* (3*a*' and 3*c*,' 3*a*" and 3*c*," . . . ) is measured.

The pre-adjustment resistance values $R_{ab}$ and $R_{bc}$ $R_{ac}$ between the electrode layers 3*a* and 3*b* and between the electrode layers 3*b* and 3*c*, respectively, are measured is obtained using the following formula, wherein referential symbols L and W stand for the length and width, respectively, of the heat generating resistor member 3; $L_0$ and $W_0$, for the length and width of the adjustable resistor layer; r stands for resistance per unit length of the heat generating resistor layer 3;

$$R_{ac}=L\cdot r+L_0\cdot(W/W_0)\cdot r$$

(4) The resistance value of the adjustable resistor layer 30 is set on the lower side, which is accomplished by giving the layer 30 the pre-adjustment width $W_0$, which is wider than the target width $W_x$ for the layer 30. The width $W_0$ of the resistor layer 30 is wider than the width W of the heat generating resistor layer 3.

The resistance value of the heating member can be adjusted to a target resistance value $R_T$ by means of changing the width $W_0$ of the resistor layer 30, the resistance adjustment region, to the width $W_x$. There is the following relation between the target resistance value $R_T$ and the post-adjustment (adjusted) width $W_x$:

$$R_T=L\cdot r+L_0\cdot(W/W_x)\cdot r$$

Rearranging the above two formulas for the adjusted width $W_x$, $$Wx=\frac{R_{ac}/R_T}{L/L_0+W/W_0-R_{ac}/R_T}\cdot W$$

The adjusted width $W_x$ of the resistance adjustment region can be derived from the above formula by simply measuring the resistance value $R_{ac}$ between the electrode layers 3*a* and 3*c*.

(5) The portion of the resistor layer 30, the resistance adjustment region, equivalent to the excess width of the resistor layer 30 in the direction perpendicular to the longitudinal direction of the heat generating resistor layer, is separated from the resistor layer 30, so that the width of the resistor layer 30 is adjusted (reduced) to the width $W_x$ calculated using the above formula. This is accomplished by means of cutting an approximately 100 $\mu$m wide slit 32 (32,' 32," . . . ) in the resistor layer 30, using a CO2 layer.

A reference numeral 31 (31,' 31," . . . ) designates the portion of the resistor layer 30, the width of which has been adjusted to the width $W_x$, and a reference numeral 33 (33,' 33," . . . ) designates the portion equivalent to the shaved excessive width. The portions equivalent to the slit 32 are the eliminated portions of the resistance adjustment region and electrically conductive layer. The width W of the resistor layer 31 is wider than the width W of the heat generating resistor layer 3.

The resistor layer portion 33, which is the portion equivalent to the excess width, is disconnected, physically and electrically, from the electrode layers 3*b* and 3*c* at the correspondent end, by the slit 32.

Therefore, when a voltage is applied between the electrode layers 3*a* and 3*c*, the power is supplied to the adjusted resistor layer portion 31, but not to the cutaway excess portion 33.

The steps hereafter, that is, step (6) and thereafter, are the same as those in the embodiment illustrated in FIG. 1.

(6) The processes described in (3), (4) and (5) are carried out on all of the plurality of resistor layers 30, 30,' 30," . . . , the resistance adjustment layers, which are formed on the alumina substrate 2.

(7) A layer of glass paste is coated on the alumina substrate 2 using a printing technology, and is baked to form the glass layer 4 as the surface protective layer.

(8) After splitting lines 2*a* (FIG. 1) are cut by the CO2 laser among the plurality of heating members 1, 1,' 1, " . . . , which are formed on the same alumina substrate 2, the alumina substrate 2 is split along the splitting lines, yielding thereby the plurality of the independent heating members 1, 1,' 1," . . . , (9) The temperature detecting element 5, safety fuse 6 and the like (FIG. 1) are assembled onto each heating member 1, completing thereby the heating member 1.

According to the above described embodiment, a portion of the adjustable resistor layer 30, the resistance adjustment region, of each heating member 1 is isolated to adjust the width of the adjustable resistor layer 30 from the pre-adjustment width $W_0$ to the width $W_x$, correspondent to the target resistance value $R_T$, which does not require shaving of the heat generating resistor layer 3 or the like process; therefore, even when there is nonuniformity of the resistance among the heat generating resistor layers 3 due to the difference in the thickness of the layer, the lot of the paste, the baking condition, or the like, the nonuniformity in the resistance valve between the electrodes 3*a* and 3*c* can be reduced to an extremely small level among the finished heating members 1, without affecting the heat distribution of the heat generating resistor layer 3.

As a result, the rejection ratio for the heating member in the final form drops to an extremely small one, which along with the fact that the heat generating resistor layer and resistance adjustment region are of the same paste, and that electrode 3*b* can be eliminated, further reduces the cost.

Figure 3:
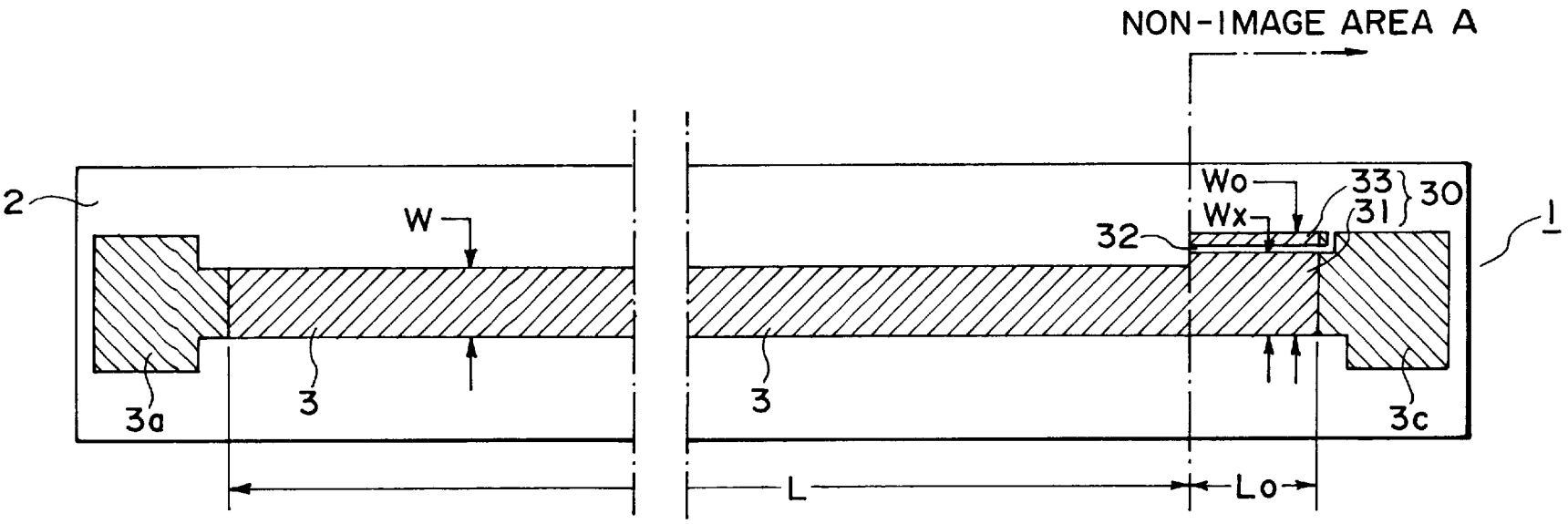
FIG. 3 is a plan view of another embodiment of a heater in accordance with the present invention.

FIG. 3 illustrates a case in which the excess width portion 33 of the resistor layer 30, the resistance adjustment region, is separated by the slit 32, being thereby electrically disconnected from the electrode layers 3*b* and 3*c* at the end. However, a different configuration may be adopted; for example, as long as the excess width portion 33 is electrically disconnected from the adjusted resistor layer 31, it may remain electrically connected to the electrode layer 3*c*.

In such a case, it is conceivable that when a high voltage spike noise is present between the terminal electrode layers 3*a* and 3*c*, sparks may fly across the slit 32, which may cause a fire; therefore, it is preferable that a filter or the like is disposed within the electrical circuit.

However, when both ends of the excess width portion 33 are separated from the correspondent electrode layers 3*b* and 3*c* by the slit 32, being thereby electrically disconnected, as illustrated in FIG. 1 the drawing, the interposition of such a filter or the like is unnecessary.

Further, in this embodiment, the resistance value of the resistance adjustment region was adjusted by adjusting the width of the resistor layer. However, as long as the resistance is adjusted within the resistance adjustment region, there is no limitation with regard to the configuration of the portion to be separated, or the method for separating it.

Next, referring to FIG. 4, another embodiment of the present invention will be described.

This embodiment is similar to the preceding embodiment (FIG. 3) except that the excess width portion 33 to be cut away from the adjustable resistor layer 30, the resistance adjustment region, was entirely erased, wherein a reference numeral 34 designates the area from which the excess width portion 33 has been completely removed.

As a means for removing entirely the excess width portion 33, the entire area correspondent to the excess width portion 33 may be scanned by the same CO2 laser that was used to cut the 100 $\mu$m wide slit 33.

When the excess width portion 33 is entirely erased, the occurrence of sparking can be prevented even when a spike noise with a much higher voltage is present between the terminal electrode layers 3*a* and 3*c*.

In the preceding embodiments, the resistance adjustment region or electrode layer portions, were removed before the surface protective layer 4 for the heating member was formed. However, the removal process may be carried out in the following order: the resistor layer 30 (and electrode layer portion) is formed as illustrated in FIG. 5(A); the glass layer 41 as the surface protective layer is formed as illustrated in FIG. 5(B); a slit 42 is cut in the resistor layer 30 of the resistance adjustment region, at well as in the glass layer 41 as illustrated in FIG. 5(C); and the glass layer is formed again (glass layer 43) as illustrated in FIG. 5(D).

The slit 42 may be formed using means other than the laser beam: for example, it may be formed through shaving with a sharpening stone or a blade.

Further, the resistance value may be adjusted by means of grinding down the resistor layer 30, the resistance adjustment region, on the substrate 2, from a thickness $D_1$ of the resistor layer 30 to a thickness $D_x$, as illustrated in FIG. 5(E).

Figure 5:
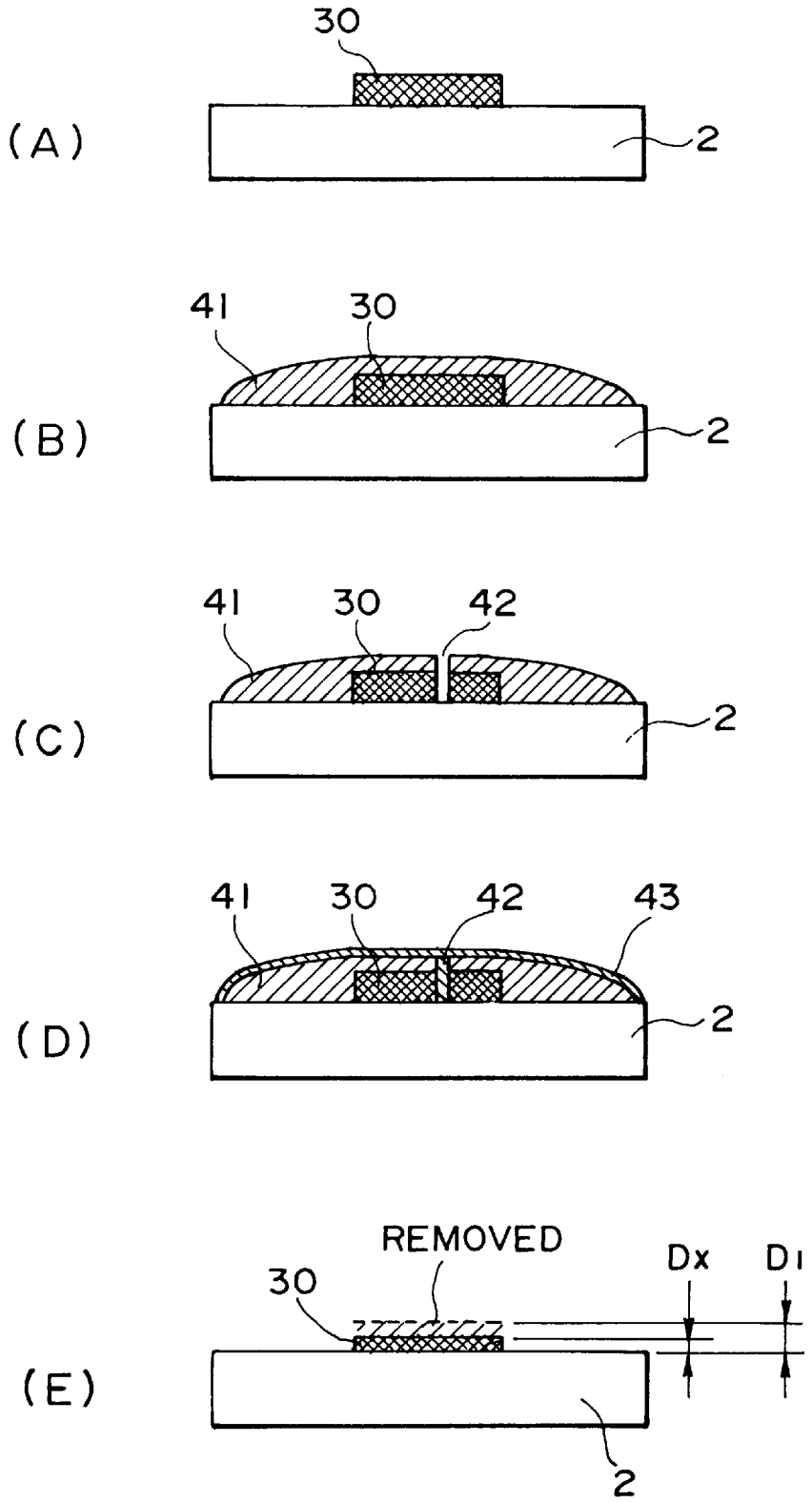
FIGS. 5(*a–e*) is an explanatory drawing describing various embodiments of the present invention.

In the embodiments illustrated in FIGS. 1, 3 and 5, when the slit was cut in the resistance adjustment region, constituted of the resistor layer and electrode layer, the slit was formed on only one side of the resistance adjustment region relative to the longitudinal direction of the heating member. However, the slit may be cut on both sides.

Further, the slit may be cut so that the separated excess width portion falls within the width of the adjusted resistance adjustment region, constituted of the resistor layer and electrode layer, relative to the width thereof.

Figure 2:
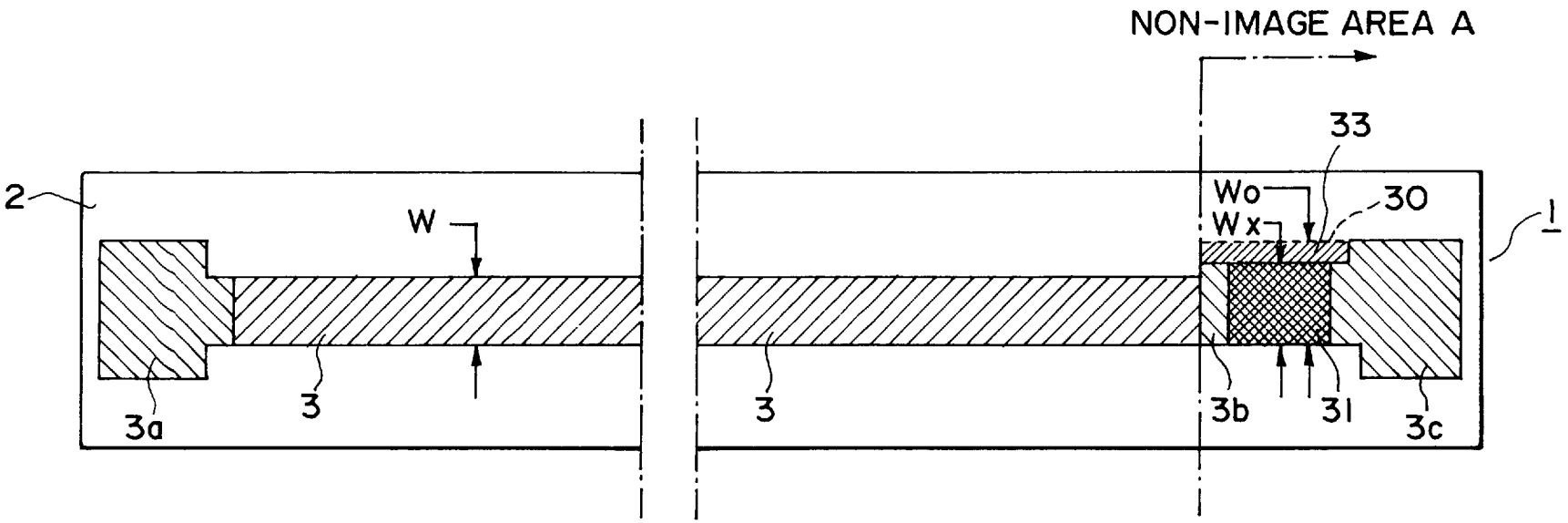
FIG. 2 is a plan view of another embodiment of a heater in accordance with the present invention.
Figure 4:
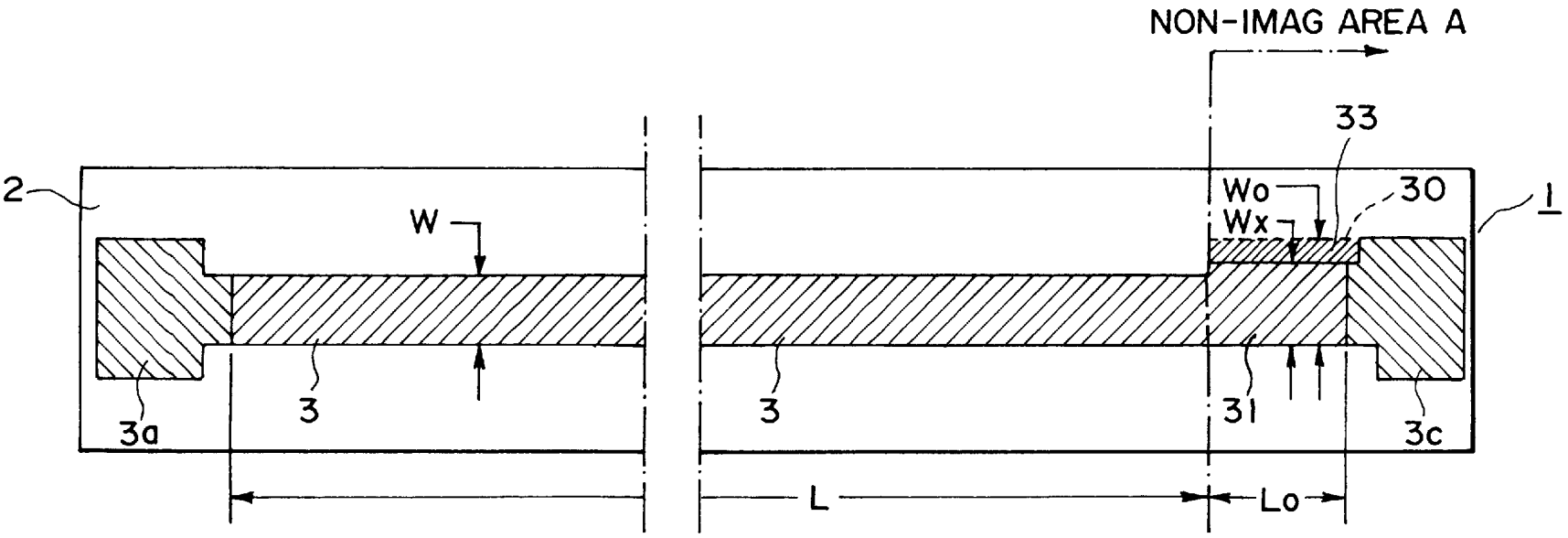
FIG. 4 is a plan view of another embodiment of a heater in accordance with the present invention.

In the embodiments illustrated in FIGS. 2 and 4, when the resistance adjustment region constituted of the resistor layer and electrode is removed, it is removed from only one side relative to the longitudinal direction of the heating member. However, it may be removed from both sides of the resistance adjustment region.

Further, the area from which the excess width portion is removed may fall within the width of the adjusted resistance adjustment region, relative to the longitudinal direction of the heating member.

In the embodiments illustrated in FIGS. 1–5, the resistor layer and electrode layers, which constituted the resistance adjustment region, were disposed on only one end in the longitudinal direction of the heating member, but they may be provided on both ends. In essence, the configuration and adjusting means are not limited to those described above as long as the resistance adjustment region is disposed outside the image forming region A.

In the embodiments illustrated in FIGS. 1–5, the resistance value of the heat generating resistor layer itself was not adjusted. However, the overall resistance of the heating member may be adjusted, using the resistance layer which constitutes the resistance adjustment region, after the resistance value of the heat generating resistor layer is adjusted to correct the heat distribution thereof.

Figure 6:
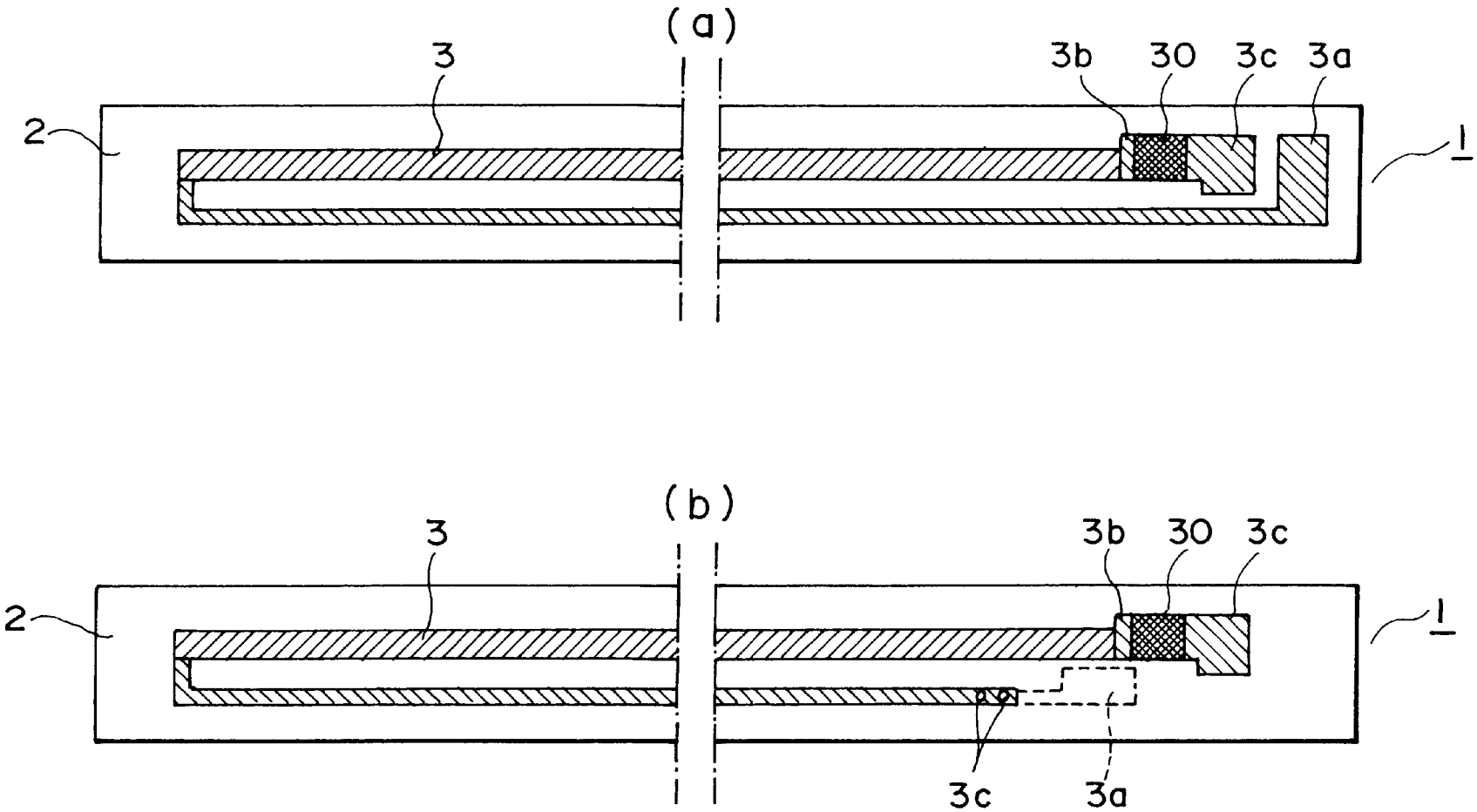
FIGS. 6(*a–b*) are plan views of a heater to which the present invention is applicable.

Further, in the embodiments illustrated in FIGS. 1–5, the electrode layer 3*a* was disposed at one end of the substrate 2, and the electrode layer 3*c* was disposed at the other end. However, these electrodes layers may be disposed as illustrated in FIG. 6(*a*), in which both electrodes layers are disposed at the same end of the substrate 2. Also, they may be disposed as illustrated in FIG. 6(*b*), in which one of the electrode layers may be disposed on the back side of the substrate 2. In the case of the latter arrangement, electrical connection is established by way of a through hole 3*s* (through hole made for connecting electrically the electrode layer portions disposed on the top and bottom sides). In essence, where and how the electrodes layers are disposed is not limited to the arrangements described in those embodiments.

As is evident from the descriptions given above, according to the present invention, the nonuniformity of the resistance, which is created among the finished heating members 1 when the heat generating resistor layer, and the resistor layer constituting the resistance adjustment region, are formed, can be reduced without affecting the heat distribution, while maintaining the yield.

The method for adjusting the heating member resistance, which was presented in the embodiments described above, may be adopted as a method for giving each heating member an optional resistance value without affecting the heat distribution of the heat generating resistor layer.

Each FIGS., 7(*a*), 7(*b*) and 7(*c*), illustrates a different structure of a heating apparatus of the film heating type, to which the present invention is applicable.

Figure 7:
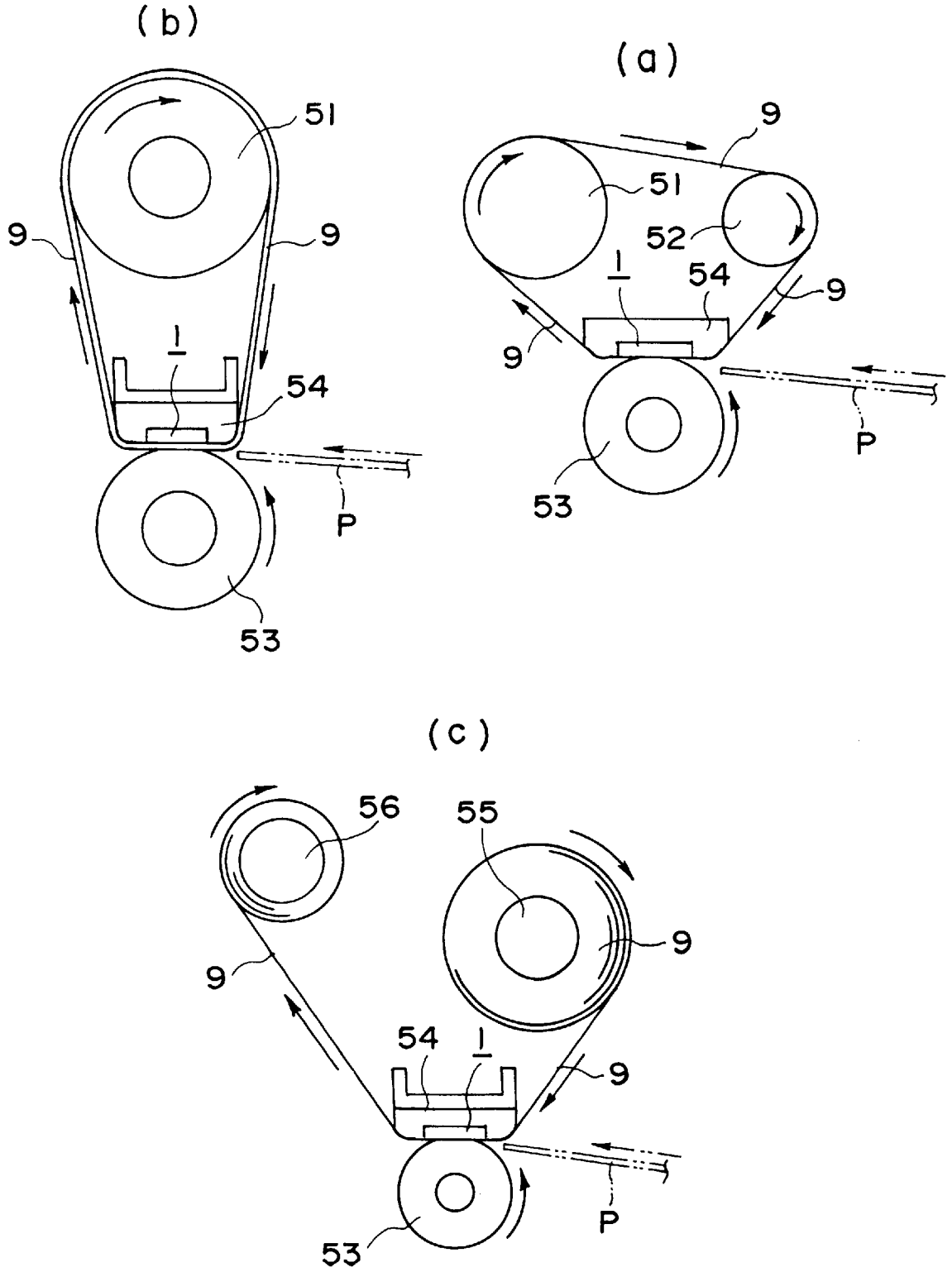
FIGS. 7(*a–c*) are schematic side views of a heat fixing apparatus to which the present invention is applicable.

In the case of the one illustrated in FIG. 7(*a*) , a heat resistance film 9 in the endless belt form is stretched around three members of a heating member 1, a driving roller 91, and a follower roller 52 (tension roller), wherein the heat resistance film 9 is driven by the driving roller 51 around the three members. A reference numeral 53 designates a pressure roller pressed on the heating member 1, with the interposition of the film 9. Its rotation is slaved to the rotational movement of the film 9. A reference numeral 52 designates a heater holder.

In the case of the one illustrated in FIG. 7(*b*) , an endless belt of heat resistance film 9 is stretched around two members, a heating member 1 and a driving member, and the film 9 is rotatively driven by the driving roller 51.

In the case of the one illustrated in FIG. 7(*c*) , a heat resistance film 9 is not in the form of an endless belt. Instead, it is in the form of a long roll, which is rolled out from the feeding shaft 55 side, is passed around a heating member 1, being in contact with it, and is taken up by a take-up shaft 56, at a predetermined speed.

While the invention has been described with reference to the structures disclosed herein, it is not confined to the details set forth, this application is intended to cover such modifications or changes as may come within the purposes of the improvements or the scope of the following claims.

What is claimed is:

1. A heater comprising:

a substrate;

a heat generating resistor on said substrate to generate heat when supplied with electric energy;

a pair of electrodes for supplying the energy to said heat generating resistor; and a resistance adjustment portion for adjusting the resistance between said electrodes, wherein said resistance adjustment portion adjusts the resistance while maintaining uniform electrical conductivity between said electrodes and said heat generating resistor.

2. A heater according to claim 1, wherein said resistance adjustment portion is a partially removed portion to adjust the resistance.

3. A heater according to claim 2, wherein said resistance adjustment portion is reduced in width in a direction perpendicular to a direction of the energy supply.

4. A heater according to claim 2, where said resistance adjustment portion is reduced in its thickness.

5. A heater according to claim 1, wherein said resistance adjustment portion is formed by printing and baking, using silver-palladium.

6. A heater according to claim 1, wherein the resistance of said resistance adjustment portion is higher than the resistances of said electrodes.

7. A heater according to claim 1, wherein a width of said resistance adjustment portion in the direction perpendicular to the energy supply direction is larger than that of said heat generating resistor.

8. A heater according to claim 1, wherein an electrically conductive portion having a smaller resistance value than that of said resistance adjustment portion is provided between said resistance adjustment portion and said heat generating resistor.

9. A heater according to claim 1, wherein said resistance adjustment portion and said heat generating resistor are contiguously formed of the same material.

10. A heat fixing apparatus for heat-fixing a toner image on a recording material, comprising:

a heater; and a film movable with the recording material, one surface of said film being in contact with said heater, and the other surface being contactable with the recording material, wherein heat from said heater is transferred to the recording material through said film, and wherein the heater comprises:

a substrate;

a heat generating resistor on said substrate to generate heat when supplied with electric energy;

a pair of electrodes for supplying the energy to said heat generating resistor; and a resistance adjustment portion provided between said heat generating resistor and one of said pair of electrodes, for adjusting the resistance between said electrodes, wherein said resistance adjustment portion adjusts the resistance while maintaining uniform electrical conductivity between said electrodes and said heat generating resistor.

11. A heat fixing apparatus according to claim 10, wherein said resistance adjustment portion is disposed outside an image forming region.

12. A heat fixing apparatus according to claim 10, wherein the resistance is adjusted by partially removing said resistance adjustment region.

13. A heat fixing apparatus according to claim 12, wherein said resistance adjustment portion is reduced in width in a direction perpendicular to the energy supply direction.

14. A heat fixing apparatus according to claim 12, wherein said resistance adjustment portion is reduced in thickness.

15. A heat fixing apparatus according to claim 10, wherein said resistance adjustment portion is formed through a step of printing a pattern thereof using silver-palladium paste, and a step of baking the printed pattern.

16. A heat fixing apparatus according to claim 10, wherein the resistance of said resistance adjustment portion is higher than the resistances of said electrodes.

17. A heat fixing apparatus according to claim 10, wherein said resistance adjustment portion is wider than said heat generating resistor, in a direction perpendicular to the energy supply direction.

18. A heat fixing apparatus according to claim 10, wherein an electrically conductive portion having a lower resistance value than that of said resistance adjustment portion is provided between said resistance adjustment portion and said heat generating resistor.

19. A heat fixing apparatus according to claim 10, wherein said resistance adjustment portion and said heat generating resistor are contiguously formed of the same material.

20. A heater comprising:

a substrate;

a heat generating resistor on said substrate to generate heat when supplied with electric energy;

an electrode for supplying energy to said heat generating resistor; and a high resistance portion provided between said heat generating resistor and said electrode, wherein said high resistance portion is wider than said heat generating resistor, in a direction perpendicular to the energy supply direction, and has a higher resistance than that of said electrode, wherein said high resistance portion adjusts the resistance between said heat generating resistor and said electrode while maintaining uniform electrical conductivity between said electrode and said heat generating resistor.

21. A heater according to claim 20, wherein said high resistance portion is formed through a step of printing the pattern thereof, using silver-palladium paste, and a step of baking the printed pattern.

22. A heater according to claim 20, wherein an electrically conductive portion, having a lower resistance value than that of said high resistance portion, is provided between said, high resistance portion and said heat generating resistor.

23. A heater according to claim 20, wherein said high resistance portion and said heat generating resistor are contiguously formed of the same material.

24. A heat fixing apparatus for heat-fixing a toner image on a recording material, comprising:

a heater; and a film movable with the recording material, one of the surfaces of said film being in contact with said heater, and the other being contactable with the recording material, wherein heat from said heater is transferred to the recording material through said film, said heater comprising:

a substrate;

a heat generating resistor on said substrate for generating heat when supplied with electric energy;

an electrode for supplying energy to said heat generating resistor; and a high resistance portion provided between said heat generating resistor and said electrode, wherein said high resistance portion is wider than said heat generating resistor, in a direction perpendicular to the energy supply direction, and has a higher resistance than that of said electrode, wherein said high resistance portion adjusts the resistance between said heat generating resistor and said electrode while maintaining uniform electrical conductivity between said electrode and said heat generating resistor.

25. A fixing apparatus according to claim 24, wherein said high resistance portion is provided outside an image forming region.

26. A fixing apparatus according to claim 24, wherein said high resistance portion is formed through a step of printing the pattern thereof using silver-palladiun paste, and a step of baking the printed pattern.

27. A fixing apparatus according to claim 24, wherein an electrically conductive portion having a lower resistance value than that of said high resistance portion is provided between said high resistance portion and said heat generating resistor.

28. A fixing apparatus according to claim 24, wherein said high resistance portion and said heat generating resistor are contiguously formed of the same material.

* * * * *

UNITED STATES PATENT AND TRADEMARK OFFICE

CERTIFICATE OF CORRECTION

PATENT NO. : 5,966,577

DATED : October 12, 1999

INVENTOR(S): ATSUYOSHI ABE

It is certified that error appears in the above-identified patent and that said Letters Patent is hereby corrected as shown below:

COLUMN 2:
Line 63, "is an explanatory drawing" should read --are explanatory drawings--.

COLUMN 3:
Line 48, "alit" should read --slit--.

COLUMN 6:
Line 1, "(3a,'" should read --3a',--;
Line 2, "(3a," 3b" and 3c,"" should read --3a", 3b" and 3c",--;
Line 7, "3,' 3,"" should read --3', 3",--;
Line 13, "(30,' 30,"" should read --(30', 30",--;
Line 15, "(3c,' 3b" and 3c,"" should read --3c', 3b" and 3c",--;
Line 17, "(30,' 30,"" should read --(30', 30",--;
Line 30, "3c,' 3a" and 3c,"" should read --3c', 3a" and 3c",--;
Line 38, "i $R_{ac}$" should read --$R_{ac}$--;
Line 64, "(32,'" should read --(32',--;
Line 65, "32,"" should read --32",--; and (CO2" should read --$CO_2$--; and
Line 66, "(31,' 31,"" should read --(31', 31",--.

UNITED STATES PATENT AND TRADEMARK OFFICE

CERTIFICATE OF CORRECTION

PATENT NO. : 5,966,577

DATED : October 12, 1999

INVENTOR(S): ATSUYOSHI ABE

It is certified that error appears in the above-identified patent and that said Letters Patent is hereby corrected as shown below:

COLUMN 7:

Line 2, "(33,' 33,"" should read --(33', 33",--;
Line 26, "30,' 30,"" should read --30', 30",--;
Line 32, "COS" should read --$CO_2$--;
Line 33, "1,' 1,"" should read --1', 1",--;
Line 36, "1," should read --1',--; and
Line 37, "`1,"" should read --1",--.

COLUMN 8:

Line 32, "CO2" should read --$CO_2$--; and
Line 63, "3c,' 3a" and 3c,"" should read 3c', 3a" and 3c",--.

COLUMN 9:

Line 40, "(32,'" should read --(32',--;
Line 41, "32,"" should read --32",--; and "CO2 layer." should read --$CO_2$ laser.--;
Line 42, "(31,' 31,"" should read --(31', 31",--;
Line 44, (33,'" should read --(33',--; and
Line 62, "30,' 30,"" should read --30', 30",--.

UNITED STATES PATENT AND TRADEMARK OFFICE

CERTIFICATE OF CORRECTION

PATENT NO. : 5,966,577

DATED : October 12, 1999

INVENTOR(S): ATSUYOSHI ABE

It is certified that error appears in the above-identified patent and that said Letters Patent is hereby corrected as shown below:

COLUMN 10:

Line 1, "CO2" should read --$CO_2$--;
Line 2, "1,' 1,"" should read --1', 1",--;
Line 6, "1,' 1,"" should read --1', 1",--; and
Line 64, "CO2" should read --$CO_2$--.

Signed and Sealed this

Thirteenth Day of June, 2000

*Attest:*

Q. TODD DICKINSON

*Attesting Officer*

*Director of Patents and Trademarks*